US006647234B2

(12) United States Patent
Herman et al.

(10) Patent No.: US 6,647,234 B2
(45) Date of Patent: Nov. 11, 2003

(54) DEVELOPER STORAGE AND DELIVERY SYSTEM FOR LIQUID ELECTROPHOTOGRAPHY

(75) Inventors: Gay L. Herman, Cottage Grove, MN (US); James A. Baker, Hudson, WI (US); Eric D. Dalzell, North St. Paul, MN (US); Manuel Lozada, New Brighton, MN (US); Brian P. Teschendorf, Vadnais, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/127,232

(22) Filed: Apr. 19, 2002

(65) Prior Publication Data

US 2003/0072589 A1 Apr. 17, 2003

Related U.S. Application Data

(60) Provisional application No. 60/329,120, filed on Oct. 12, 2001.

(51) Int. Cl.[7] ..... G03G 15/10

(52) U.S. Cl. ..... 399/238; 430/114; 430/116; 430/117

(58) Field of Search ..... 399/237, 238; 347/88; 430/117, 118, 112, 116, 45, 114

(56) References Cited

U.S. PATENT DOCUMENTS

| | | | | | |
|---|---|---|---|---|---|
| 5,073,798 | A | * | 12/1991 | Shirakura et al. | 399/238 |
| 5,075,735 | A | | 12/1991 | Tsuchiya et al. | 399/225 |
| 5,229,235 | A | | 7/1993 | Watanabe et al. | 430/45 |
| 5,517,288 | A | | 5/1996 | Martin et al. | 399/262 |
| 5,695,904 | A | | 12/1997 | Larson et al. | 430/119 |
| 5,723,250 | A | * | 3/1998 | Matsuoka et al. | 430/117 |
| 5,783,350 | A | | 7/1998 | Matsuoka et al. | 430/116 |
| 5,815,780 | A | | 9/1998 | Boerger | 399/260 |
| 5,998,081 | A | | 12/1999 | Morrison et al. | 430/117 |
| 6,261,732 | B1 | * | 7/2001 | Morrison et al. | 430/117 |
| 6,546,221 | B2 | * | 4/2003 | Baker et al. | 399/237 |
| 2002/0197552 | A1 | * | 12/2002 | Baker et al. | 430/114 |

FOREIGN PATENT DOCUMENTS

| | | | |
|---|---|---|---|
| EP | 0 348 844 | | 10/1994 |
| JP | 03-028872 | * | 2/1991 |
| JP | 03-109588 | * | 5/1991 |

OTHER PUBLICATIONS

Yoshikawa, et al., "Thermal Offset Printing with Melt Transfer Type Ink (Top–M)," The 9$^{th}$ International Congress on Advance in Non–Impact Printing Technologies/ Japan Hardcopy '93, Oct. 4–8, 1993, Picifico Yokohama, Yokohama, Japan, pp. 330–333.

* cited by examiner

*Primary Examiner*—Sophia S. Chen
(74) *Attorney, Agent, or Firm*—Mark A. Litman & Assoc. P.A.

(57) ABSTRACT

This invention relates to a developer storage and delivery system for liquid electrophotography containing:

a) a container having an open end;

b) a developer inside said container wherein said developer has a viscosity greater than 10 pascal second; and c) a heater near said open end wherein said heater lower the viscosity of said developer to less than 0.01 pascal second.

11 Claims, 2 Drawing Sheets

DEVELOPER STORAGE AND DELIVERY SYSTEM FOR LIQUID ELECTROPHOTOGRAPHY

This application claims the benefit of provisional application No. 60/329,120 filed Oct. 12, 2001

BACKGROUND OF THE INVENTION

1. Field of the Invention

This invention relates generally to a developer storage and delivery system, and more particularly concerns storing a phase change developer in a developer tank and a process for delivering the phase change developer to a liquid electrophotographic developing system.

2. Background of the Art

In electrophotography, a photoreceptor in the form of a plate, belt, sheet, disk, or drum having an electrically insulating photoconductive element on an electrically conductive substrate is imaged by first uniformly electrostatically charging the surface of the photoconductive element, and then exposing the charged surface to a pattern of light. The light exposure selectively dissipates the charge in the illuminated areas, thereby forming a pattern of charged and uncharged areas (i.e. an electrostatic latent image). A liquid or dry developer is then deposited in either the charged or uncharged areas to create a toned image on the surface of the photoconductive element. The resulting visible image can be fixed to the photoreceptor surface or transferred to a surface of an intermediate transfer material or a suitable receiving medium such as sheets of material, including, for example, paper, transparency, metal, metal coated substrates, composites and the like. The imaging process can be repeated many times on the reusable photoconductive element.

In some electrophotographic imaging systems, the latent images are formed and developed on top of one another in a common or extended imaging region of the photoreceptor. The latent images can also be formed and developed in multiple passes of the photoreceptor around a continuous transport path (i.e., a multi-pass system). Alternatively, the latent images can be formed and developed in a single pass of the photoreceptor around the continuous transport path. A single-pass system enables the multi-color images to be assembled at extremely high speeds relative to the multi-pass system. At each color development station, color developers are applied to the photoreceptor belt, for example, by electrically biased rotating developer rolls.

Image developing methods can be classified into liquid type developing methods and dry type developing methods. The dry type method uses dry developers and the wet type method uses liquid developers.

Dry developers are generally prepared by mixing and dispersing colorant particles and a charge director into a thermoplastic binder resin, followed by milling or micropulverization. The resulted developer particle sizes are generally in the range of about 4 to 10 microns. If the fine powder of a dry developer is scattered, it poses an environmental problem because of its small particle size. Therefore, most dry developers are stored in a cartridge which is easily handled and disposed of Furthermore, the stability of dry developer is usually much better than that of liquid developer.

Liquid developers are usually prepared by dispersing colorant particles, a charge director, and a binder in an insulating liquid (i.e., a carrier or a vehicle). Liquid developer based imaging systems incorporate many features similar to those of dry developer based system. However, liquid developer particles are significantly smaller than dry developer particles. Because of their small particle size, ranging from 3 microns to submicron size, liquid developers are capable of producing very high resolution images. However, liquid developers have some drawbacks.

The major drawbacks of liquid developers are (1) the emission of the liquid carrier from liquid developers to the environment during the drying and transfer process due to inefficient solvent recovery system; (2) the need and difficulty in disposing the waste liquids; (3) the inconvenience of using and handling of liquid developers; (4) and the aggregation and sedimentation instability of materials within liquid developers.

While known liquid developers and processes are suitable for their intended purposes, a need remains for liquid developers and processes that reduce or substantially eliminate the above-mentioned drawbacks. Additionally, there is a need for liquid developers and processes that enable the formation of high quality images on a wide variety of substrates.

There have been attempts to solve some of the above-mentioned drawbacks of liquid developers and dry developers reported in the art. For example, U.S. Pat. No. 5,075,735 to Tsuchiya et al. discloses a developer delivery system comprising stripes or bars of solid developer mounted across a belt. The stripes or bars of solid developer are caused to drop on a heater by a cutter and then melted by the heater into liquid. The resulted liquid developer is then used to develop electrophotographic images.

U.S. Pat. No. 5,783,350 to Matsuoka et al. discloses a meltable developer in a developer tank. The meltable developer is melted by heaters located around the sidewalls of the developer tank and in the bottom of the developer tank. The melted developer is caused to form developed images on a photosensitive body by electrophoresis.

U.S. Pat. No. 5,229,235 to Watanabe et al. discloses an electrophotographic process using a meltable developer. The meltable developer is stored in a developer tank and melted by heaters located in the bottom of the developer tank. The melted developer is caused to form visible images by contacting with electrostatic latent images.

The above attempts still suffer the drawbacks of emission of carrier vapor to the environment; chemical and physical degradation of the developer due to exposure to elevated temperature for long time; and the complexity of the control systems for adjusting the amount and concentration of the molten developer in the developer tank.

SUMMARY OF THE INVENTION

This invention provides an improved developer storage and delivery system which eliminates at least some drawbacks of liquid developers and processes while it provides high quality images on a wide variety of substrates.

In a first aspect, the invention features a developer storage and delivery system for liquid electrophotography that includes:

a) a container having an open end;

b) a phase change developer inside said container wherein said phase change developer has a melting point of at least about 22° C.; and c) a heater near said open end wherein said heater melts at least the top surface of said phase change developer.

In a second aspect, the invention features a developer storage and delivery system for liquid electrophotography that includes:

a) a container having an open end;

b) a developer inside said container wherein said developer has a viscosity greater than 10 pascal second at room temperature and pressure (e.g., 18° C. and 760 mm Hg); and c) a heater near said open end wherein said heater lower the viscosity of said developer to less than 0.01 pascal second at room temperature and pressure (e.g., 18° C. and 760 mm Hg).

The developer storage and delivery system of the present invention will be described primarily with respect to electrophotographic office printing; however, it is to be understood that these developers are not so limited in their utility and may also be employed in other imaging processes, other printing processes, or other developer transfer processes, such as high speed printing presses, photocopying apparatus, microfilm reproduction devices, facsimile printing, ink jet printer, instrument recording devices, and the like.

BRIEF DESCRIPTION OF THE DRAWINGS

The foregoing advantages, construction and operation of the present invention will become more readily apparent from the following description and accompanying drawings in which.

DETAILED DESCRIPTION OF INVENTION

Liquid electrophotography is a technology that produces or reproduces an image on a receiving surface such as paper or other desired receiving material. Liquid electrophotography uses liquid developers which may be black or which may be of different colors for the purpose of plating solid colored material onto a surface in a well-controlled and image-wise manner to create the desired prints. Typically, a colored image is constructed of four image planes. The first three planes are constructed with a liquid developer in each of the three subtractive primary printing colors, yellow, cyan and magenta. The fourth image plane uses black developer.

Figure 1:
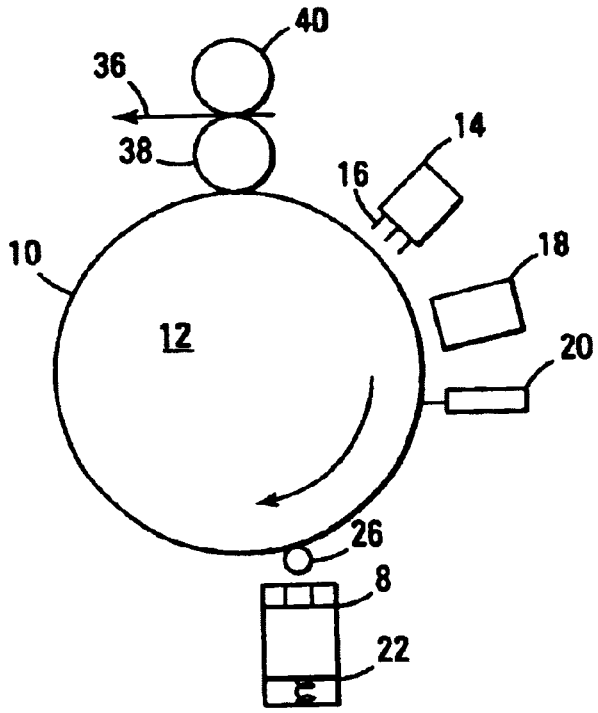
FIG. 1 is a diagrammatic illustration of a basic liquid electrophotographic process in which the present invention has utility and an apparatus for performing that process.

The typical process involved in liquid electrophotography can be illustrated with respect to a single color by reference to FIG. 1. Light sensitive photoreceptor 10 is arranged on or near the surface of a mechanical carrier such as drum 12. Photoreceptor 10 can be in the form of a belt or loop mounting on the outer surface of drum 12. Photoreceptor 10 can also be coated on the outer surface of drum 12. The mechanical carrier could, of course, be a belt or other movable support object. Drum 12 rotates in the clockwise direction of FIG. 1 moving a given location of photoreceptor 10 past various stationary components which perform an operation relative to photoreceptor 10 or an image formed on drum 12.

Of course, other mechanical arrangements could be used which provide relative movement between a given location on the surface of photoreceptor 10 and various components which operate on or in relation to photoreceptor 10. For example, photoreceptor 10 could be stationary while the various components move past photoreceptor 10 or some combination of movement between both photoreceptor 10 and the various components could be facilitated. It is only important that there be relative movement between photoreceptor 10 and the other components. As this description refers to photoreceptor 10 being in a certain position or passing a certain position, it is to be recognized and understood that what is being referred to is a particular spot or location on photoreceptor 10 which has a certain position or passes a certain position relative to the components operating on photoreceptor 10.

In FIG. 1, as drum 12 rotates, photoreceptor 10 moves past erase lamp 14. When photoreceptor 10 passes under erase lamp 14, radiation 16 from erase lamp 14 impinges on the surface of photoreceptor 10 causing any residual charge remaining on the surface of photoreceptor 10 to "bleed" away. Thus, the surface charge distribution of the surface of photoreceptor 10 as it exits erase lamp 14 is quite uniform and nearly zero depending upon the photoreceptor.

As drum 12 continues to rotate and photoreceptor 10 next passes under charging device 18, such as a roll corona, a uniform positive or negative charge is imposed upon the surface of photoreceptor 10. This prepares the surface of photoreceptor 10 for an image-wise exposure to radiation by laser imaging device 20 as drum 12 continues to rotate. Wherever radiation from laser imaging device 20 impinges on the surface of photoreceptor 10, the surface charge of photoreceptor 10 is reduced significantly while areas on the surface of photoreceptor 10 which do not receive radiation are not appreciably discharged. Areas of the surface of photoreceptor 10 which receive some radiation are discharged to a degree that corresponds to the amount of radiation received. This results in the surface of photoreceptor 10 having a surface charge distribution which is proportional to the desired image information imparted by laser imaging device 20 when the surface of photoreceptor 10 exits from under laser imaging device 20.

Figure 2:
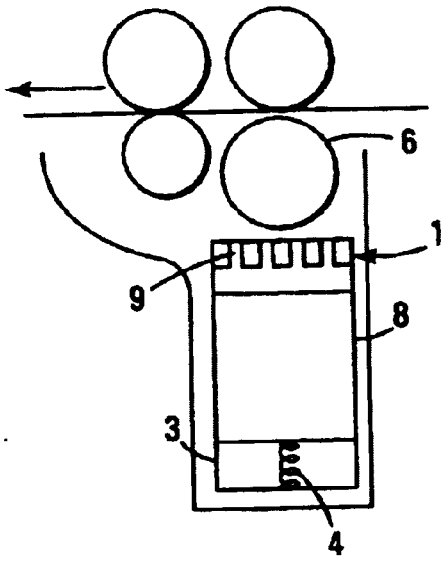
FIG. 2 is a diagrammatic illustration of a developer storage and delivery system wherein a phase change developer is placed in a developer tank fitted with a heater near the top.

As drum 12 continues to rotate, the surface of photoreceptor 10 passes by developer storage and delivery system 22 containing developer 8, which is the subject matter of this invention. The principle of the developer storage and delivery systems suitable for this invention is explained by referring to FIG. 2. The developer storage and delivery system in FIG. 2 comprises developer 8 in developer tank 3. Developer 8 is urged toward heating element 1 located above developer 8 by indexing unit 4. Developer 8 can be any conventional liquid developer having high viscosities or any phase change developer which is described in detail later. Preferably, developer 8 is a phase change developer.

The toner images plated on the surface of organophotoreceptor 10 is further dried by drying mechanism 34. Drying mechanism 34 may be passive, may utilize active air blowers blowing hot air 90, or may be other active devices such as rollers or IP lamp. In a preferred embodiment, drying mechanism is passive such that most of the carrier fluid is absorbed by the receiving medium.

Figure 3:
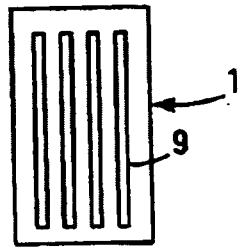
FIG. 3 is a diagrammatic illustration of a heater suitable for this invention.

Heating element 1 can be any heating element or heating lamp known in the art. Heating element 1 can be in the form of a plate, wires, bars, or a net. The heating elements may be made of any material that is resistant to heat and carrier liquids such as hydrocarbons. Non-limiting examples of materials for the heating elements are metals and ceramics. Preferably, heating element 1 is in the form of a plate made of ceramic and having openings 9 as shown in FIG. 3.

The present invention describes a developer storage and delivery system for effecting liquid electrophotography from a phase change developer source comprising a container having a dispensing end; a phase change developer inside said container wherein said phase change developer has a melting point of at least 22° C.; and a heater to heat at least a surface of the phase change developer in mass transport relationship to the dispensing end. By mass transport relationship is meant that developer may move (e.g., mass flow) within the container to and eventually through the open end. The developer storage and delivery system for liquid electrophotography accordingly may further comprise a motivator for moving said phase change developer toward said heater in a controlled manner. The motivator is any component or system that provides force or opportunity (enabling gravity to provide the force) to cause the phase change developer in a solid or unactivated state or not completely flowable state to move towards the heater to allow the heater to heat the phase change developer so that it can move towards the open end. Such motivators are described herein as providing physical forces, for example, by springs, air pressure, liquid pressure, panel movement, plunger movement, etc, to move the solid phase change developer. This is a physical element with little functional criticality associated with its operation as long as movement of the phase change developer is effected.

The invention may further be described in alternative embodiments as a developer storage and delivery system for liquid electrophotography comprising:

a) a container having an open end;

b) a developer inside said container wherein said developer has a viscosity greater than 10 pascal second; and c) a heater to lower the viscosity of said developer to less than 0.01 pascal second so that heated developer may move towards said open end.

Heating element 1 heats a thin layer of developer 8 at the top to an appropriate temperature that would allow the toner particles to have the correct mobility and conductivity to be useful in a printing mode. The heating element 1 may be resistive, semiconductor, laser driven, radiation emitting, conductive, convective, or the like. The mobility of the toner particles in heated developer 8 should be in the range of $1\times10^{-9}$ to $1\times10^{-12}$ $m^2$/V.sec. The conductivity of the heated developer 8 should be in the range of 10 to 1200 picomho-$cm^{-1}$. Heated developer 8 passes through openings 9 of heating element 1 to reach developer roll 6. Developer 8 below the heated top layer remains unchanged until the heated top layer is consumed and exposed the next layer below it. As developer 8 is consumed in the printing process, developer 8 would be indexed up by indexing unit 4 to allow the printing apparatus to have a constant source of developer.

This indexing could be done by using spring loading and tension, cylinder pressure against a sliding solid tube of solid developer, step motor drive, pneumatic or vapor pressure behind the solid developer, or any other method of progressively advancing a given supply of solid developer or replacing solid developer; a print or dot counting device that manual indexes solid phase change developer 8 up according to use; or a device that uses weight as an indication of the need to index. A microprocessor may therefore be associated with the system to control and analyze the utilization rate of the solid developer.

Developer tank 3 may be in any dimension and shape suitable for modem printers, fax machine, and copier. Developer tank 3 may be made of any material that is resistant to heat and carrier liquids such as hydrocarbons. Non-limiting examples of materials for developer tank 3 are metals and ceramics.

Referring back to FIG. 1, heated developer 8 is applied to the surface of image-wise charged photoreceptor 10 in the presence of a positive or negative electric field which is established by placing developer roll 26 near the surface of photoreceptor 10 and imposing a bias voltage on developer roll 26. The positive or negative electric field may also be established by placing a grounded developer roll 26 near the surface of photoreceptor 10 and imposing a bias voltage on photoreceptor 10.

The liquid developer consists of positively or negatively charged "solid" developer particles of the desired color for the portion of the image being printed. The "solid" material in the developer, under force from the established electric field, migrates to and plates upon the surface of photoreceptor 10 in areas where the surface voltage is less than the bias voltage of developer roll 26. The "solid" material in the developer will migrate to and plate by electrostatic attraction and differentiation upon the developer roll in areas where surface voltage of photoreceptor 10 is greater than the bias voltage of developer roll 26. Excess developer not sufficiently plated to either the surface of photoreceptor 10 or to developer roll 26 is removed.

The image developed on photoreceptor 10 is then transferred, either indirectly by way of transfer rollers 38 and 40, as illustrated in FIG. 1, or preferably directly to the receiving medium 36 to be printed. Typically, heat and pressure are utilized to fuse the image to receiving medium 36. The resultant "print" is a hard copy manifestation of the image information written by laser imaging device 22 and is of a single color, the color represented by liquid developer 24.

While photoreceptor 10, drum 12, erase lamp 14, charging device 18, laser imaging device 20, developer storage and delivery system 22, developer roll 26, and transfer rollers 38 and 40 have been only diagrammatically illustrated in FIG. 1 and only generally described with relation thereto, it is to be recognized and understood that these components are generally well known in the art of electrophotography and the exact material and construction of these elements is a matter of design choice which is also well understood in the art.

It is possible, of course, to make prints containing many colors rather than one single color. The basic liquid electrophotography process and apparatus described in FIG. 1 can be used by repeating the process that was described above for imaging with one color, a number of times wherein each repetition may image-wise expose a separate primary color plane, e.g., cyan, magenta, yellow or black, and each developer storage and delivery system 22 may be of a separate primary printing color corresponding to the image-wise exposed color plane. Superposition of four such color planes may be achieved with good registration onto the surface of photoreceptor 10 without transferring any of the color planes until all have been formed. Subsequent simultaneous transfer of all of these four color planes to a suitable receiving medium 36 may yield a quality color print. Older processes would transfer colors one at a time, increasing registration difficulties.

While the above described liquid electrophotography process is suitable for construction of a multi-colored image, the process is somewhat slow because photoreceptor 10 would repeat the entire sequence for each color of the typical four color colored image. When the above process is performed for a particular color, e.g., cyan, laser imaging device 20 causes areas receiving radiation to at least partially discharge to create a surface charge distribution pattern of the surface of photoreceptor 10 which represents the portion of the image to be reproduced representing that particular color, e.g., cyan. After development by developer storage and delivery system 22, the surface charge distribution of photoreceptor 10 is still quite variable (assuming at least some pattern to the image to be reproduced) and too low to be subsequently imaged. Photoreceptor 10 then should be erased to make the surface charge distribution uniform and should be again charged to provide a sufficient surface charge to allow a subsequent development process to plate liquid developer upon developed and/or undeveloped areas of photoreceptor 10.

Figure 4:
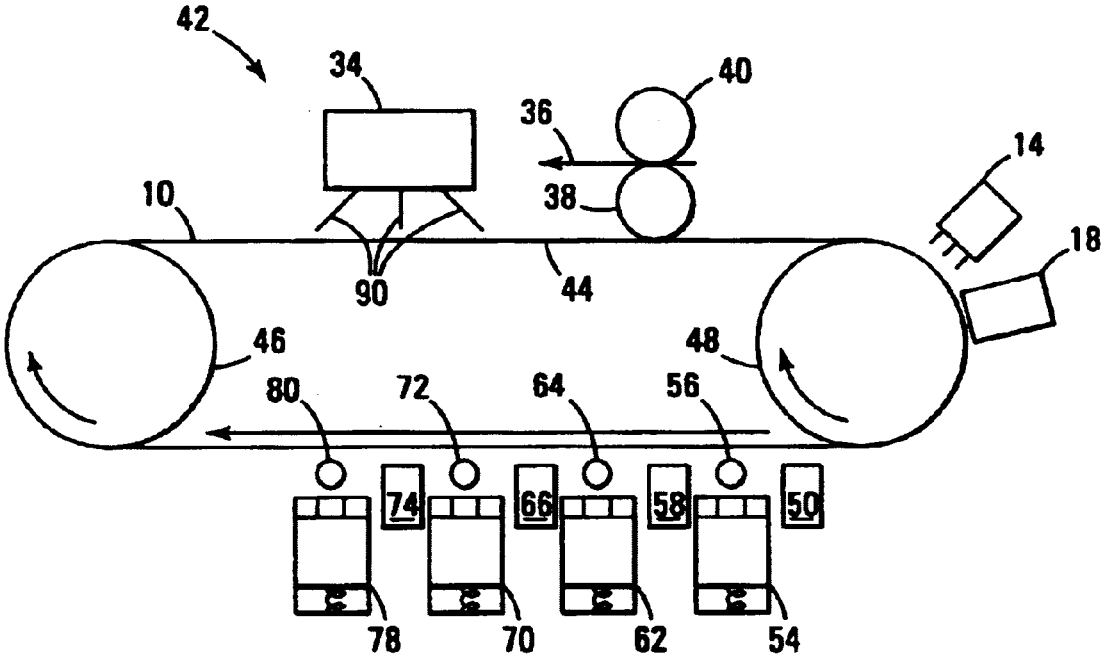
FIG. 4 is a diagrammatic illustration of an apparatus and a method for producing a multi-colored image in accordance with the present invention.

While not required by all embodiments of the present invention, FIG. 4 diagrammatically illustrates an apparatus 42 and a method for producing a multicolored image. Photoreceptor 10 is mechanically supported by belt 44 which rotates in a clockwise direction around rollers 46 and 48. Photoreceptor 10 is first conventionally erased with erase lamp 14. Any residual charge left on photoreceptor 10 after the preceding cycle is preferably removed by erase lamp 14 and then conventionally charged using charging device 18, such procedures being well known in the art. Laser imaging device 50, similar to laser imaging device 20 illustrated in FIG. 1, exposes the surface of photoreceptor 10 to radiation in an image-wise pattern corresponding to a first color plane of the image to be reproduced.

With the surface of photoreceptor so image-wise charged, charged pigment particles in a first phase change developer in developer storage and delivery system 54 corresponding to the first color plane will migrate to and plate upon the surface of photoreceptor 10 in areas where the surface voltage of photoreceptor 10 is less than the bias of developer roll 56 associated with developer storage and delivery system 54. The charge neutrality of the first phase change developer in its liquid phase is maintained by negatively (or positively) charged counter ions which balance the positively (or negatively) charged pigment particles. Counter ions are deposited on the surface of photoreceptor 10 in areas where the surface voltage is greater than the bias voltage of developer roll 56 associated with developer storage and delivery system 54.

At this stage, photoreceptor 10 contains on its surface an image-wise distribution of plated "solids" of liquid phase change developer in accordance with a first color plane. The surface charge distribution of photoreceptor 10 has also been recharged with plated developer particles as well as with transparent counter ions from liquid phase change developer both being governed by the image-wise discharge of photoreceptor 10 due to laser imaging device 50. Thus, at this stage the surface charge of photoreceptor 10 is also quite uniform. Although not all of the original surface charge of photoreceptor may have been obtained, a substantial portion of the previous surface charge of photoreceptor has been recaptured. Although photoreceptor 10 is now ready to be processed for the next color plane of the image after such recharging, it is preferably to recharge photoreceptor 10 with a corona (not shown in FIG. 3) before the next step.

As belt 44 continues to rotate, photoreceptor 10 next is image-wise exposed to radiation from laser imaging device 58 corresponding to a second color plane. Note that this process occurs during a single revolution of photoreceptor 10 by belt 44 and without the necessity of photoreceptor 10 being subjected to erase subsequent to exposure to laser imaging device 50 and developer storage and delivery system 54 corresponding to a first color plane. The remaining charge on the surface of photoreceptor 10 is subjected to radiation corresponding to a second color plane. This produces an image-wise distribution of surface charge on photoreceptor 10 corresponding to the second color plane of the image.

The second color plane of the image is then developed by developer storage and delivery system 62 containing a second phase change developer. Although the second phase change developer in its liquid phase contains "solid" color pigments consistent with the second color plane, the liquid phase change developer also contains substantially transparent counter ions which, although they may have differing chemical compositions than substantially transparent counter ions of the first liquid developer in developer storage and delivery system 54, still are substantially transparent and oppositely charged to the "solid" color pigments. Developer roll 64 provides a bias voltage to allow "solid" color pigments of liquid developer 62 create a pattern of "solid" color pigments on the surface of photoreceptor 10 corresponding to the second color plane. The transparent counter ions also substantially recharge photoreceptor 10 and make the surface charge distribution of photoreceptor 10 substantially uniform. Preferably, the uniformity of the surface charge distribution on photoreceptor 10 is further improved by corona charging.

A third color plane of the image to be reproduced is deposited on the surface of photoreceptor 10 is similar fashion using laser imaging device 66 and developer storage and delivery system 70 containing a third phase change developer using developer roll 72.

Similarly, a fourth color plane is deposited upon photoreceptor 10 using laser imaging device 74 and developer storage and delivery system 78 containing a fourth phase change developer using developer roll 80.

The completed four color image is then transferred, either indirectly by way of transfer rollers 38 and 40, as illustrated in FIG. 4, or preferably directly to the receiving medium 36 to be printed. Typically, heat and/or pressure are utilized to fix the image to receiving medium 36. The resultant "print" is a hard copy manifestation of the four color image.

With proper selection of charging voltages, photoreceptor capacity and phase change developer, this process may be repeated an indeterminate number of times to produce a multi-colored image having an indeterminate number of color planes. Although the process and apparatus has been described above for conventional three or four color images, the process and apparatus are suitable for multi-color images having two or more color planes.

Charging device 18 is may be a charged roll or a scorotron type corona charging device. Charging device 18 has high voltage surfaces (not shown) coupled to a suitable positive high voltage source. The high voltage surfaces of charging device 18 are on or near the surface of photoreceptor 10 and are coupled to an adjustable positive voltage supply (not shown) to obtain an suitable positive surface voltage on photoreceptor 10. Of course, connection to a positive voltage is required for a positive charging photoreceptor 10. Alternatively, a negatively charging photoreceptor 10 using negative voltages would also be operable. The principles are the same for a negative charging photoreceptor 10.

Laser imaging device 50 imparts image information associated with a first color plane of the image, laser imaging device 58 imparts image information associated with a second color plane of the image, laser imaging device 66 imparts image information associated with a third color plane of the image and laser imaging device 74 imparts image information associated with a fourth color plane of the image. Although each of laser imaging devices 50, 58, 66 and 74 are associated with a separate color of the image and operate in the sequence as described above with reference to FIG. 4, for convenience they are described together below.

Laser imaging devices 50, 58, 66 and 74 include a suitable high intensity electromagnetic radiation source. The radiation may be provided by a single beam or an array of beams. The array of beams may be generated by a LED (light emitting diode) array. The individual beams in such an array may be individually modulated. The radiation impinges, for example, on photoreceptor 10 as a line scan generally perpendicular to the direction of movement of photoreceptor 10 and at a fixed position relative to charging device 18.

The radiation scans and exposes photoreceptor 10 preferably while maintaining exact synchronism with the movement of photoreceptor 10. The image-wise exposure causes the surface charge of photoreceptor 10 to be reduced significantly wherever the radiation impinges. Areas of the surface of photoreceptor 10 where the radiation does not impinge are not appreciably discharged. Therefore, when photoreceptor 10 exits from under the radiation, its surface charge distribution is proportional to the desired image information.

The radiation (a single beam or array of beams) from laser imaging devices 50, 58, 66 and 74 is modulated conventionally in response to image signals for any single color plane information from a suitable source such as a computer memory, communication channel, or the like. The mechanism through which the radiation from laser imaging devices is manipulated to reach photoreceptor 10 is also conventional.

Developer storage and delivery system 54 develops the first color plane of the image, developer storage and delivery system 62 develops the second color plane of the image, developer storage and delivery system 70 develops the third color plane of the image and developer storage and delivery system 78 develops the fourth color plane of the image. Although each of developer storage and delivery systems 54, 62, 70 and 78 are associated with a separate color of the image and operate in the sequence as described above with reference to FIG. 5, for convenience they are described together below.

As mentioned above, the preferred developers for this invention are phase change developers. The phase change developers should have a melting point of at least about 22° C., more preferably at least about 30° C., and most preferably at least about 40° C. The phase change developers may comprise a colorant, a carrier, a binder resin, and optionally other additives, such as a charge director and an adjuvant.

The carrier may be selected from a wide variety of materials that are known in the art, but the carrier preferably has a Kauri-Butanol number less than 30. The carrier is typically chemically stable under a variety of conditions and electrically insulating. Electrically insulating refers to a material having a low dielectric constant and a high electrical resistivity. Preferably, the carrier has a dielectric constant of less than 5, more preferably less than 3. Electrical resistivities of carrier are typically greater than $10^9$ Ohm-cm, more preferably greater than $10^{10}$ Ohm-cm. The carrier preferably is also relatively nonviscous in its liquid state at the operating temperature to allow movement of the charged particles during development. In addition, the carrier should be chemically inert with respect to the materials or equipment used in the liquid electrophotographic process, particularly the photoreceptor and its release surface. Additional references to Kauri-butanol values include the protocol described in ASTM Standard: Designation 1133-86. However, the scope of the aforementioned test method is limited to hydrocarbon solvents having a boiling point over 40° C. The method has been modified for application to more volatile substances such as to 30° C.)

The term "phase change developer" has an accepted meaning within the imaging art, however, some additional comments are useful in view of phenomic differences amongst mechanisms in this field. As the term indicates, the developer system is present as one physical phase under storage conditions (e.g., usually a solid) and transitions into another phase during development (usually a liquid phase), usually under the influence of heat or other directed energy sources. There are basically two preferred mechanisms in which these phase changes appear: a) complete conversion of the phase change developer layer from a solid to a liquid and b) release of a liquid from a phase change developer layer with a solid carrier in the phase change developer layer remaining as a solid during and after development. The first system operates by the entire layer softening to a point where the entire layer flows, carrying the active developer component to the charge distributed areas and depositing the developer composition on the appropriate areas where the charges attract the developer. In this case, the developer may be originally or finally in a solid phase or liquid phase within the phase change developer layer, but with the softened (flowable or liquefied) layer carrying the developer or allowing the developer to move over the surface of the layer having image-effecting charge distribution over its surface. The second system, where a liquid developer forms on the surface of the phase change developer carrying layer, usually maintains a solid carrying layer with a liquid developer provided on the surface of the carrier layer. This system may function, for example, by the developer having a lower softening point or even being present as a liquid (e.g., liquid/solid dispersion, liquid/solid emulsion) in the solid carrier layer. Upon activation or stimulation (e,g., by energy, such as heat), the developer composition will exude or otherwise emit from the surface of the solid carrier. This can occur by a number of different phenomena, and the practice of the invention is not limited to any specifically described phenomenon. For example, a phase change developer layer may be constructed by blending a developer composition that is solid at 22° C., which may be dispersed in a solid binder that is solid at 70° C., and the phase change developer composition coated on the imaging surface. Upon heating of the phase change developer layer to a temperature between 25° C. and 65° C., for example, especially where the developer composition is present at from 1 to 60% by weight of the phase change developer layer, the developer will soften or liquefy, and the developer composition will flow to the surface of the developer layer. The developer may be present as droplets and spread by physical action or may flow in sufficient volume to wet the surface of the developer layer and form a continuous layer of liquid. Thus, in the practice of the present invention, the phase change developer layer may be heated above room temperature and below or above the melt, softening or flow temperature of the carrier solid in the phase change developer layer. Melting points of the thermoplastic core or the activation temperature of the phase change developer is preferred to be between 30 and 90° C., between 35° C. and 85° C., between 40 and 80° C., and between 40 and 75° C.

In certain aspects of process steps of the invention, the melting point of the phase transfer developer has been described as in the range of 22 to 40° C. If the melting point of the phase transfer developer is less than 22° C., the phase transfer developer will not be solid at room temperature. If the melting point of the phase transfer developer is greater than 40° C., image splitting may occur. In other aspects of process steps of the invention, the viscosity of the phase transfer developer is described as in the range of 0.001 to 0.01 pascal second. If the viscosity of the phase transfer developer is less than 0.001 pascal second, the liquid phase transfer developer will become too thin to be transferred on the developer, and the viscosity of the phase transfer developer is greater than 0.01 pascal second, the mobility of the liquid phase transfer developer will be too low for effective development of toned images.

The concept of an 'activation point' or 'activation temperature' is particularly easily understood in the concept of the present invention. At room temperature, below the activation temperature, the phase change developer layer will not allow the developer to readily distribute over the differentially charged layer to form a pattern or latent image or image in response to the distribution of charges. When the activation temperature has been exceeded on the phase change developer layer, the developer becomes able to be distributed over the differentially charged layer to form a pattern or latent image or image in response to the distribution of charges. The activation point or activation temperature is therefore the temperature at which the phase change developer layer passes from a state in which the developer is electrophotographically inactive to a state where the developer is electrophotographically active, as the temperature increases.

A number of classes of organic materials meet some or many of the requirements outlined above. Non-limiting examples of suitable carrier include aliphatic hydrocarbons or paraffins (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons, and the like), silicone oils and waxes, vegetable oils and waxes, animal oils and waxes, petroleum waxes, mineral waxes, synthetic wax, such as Fischer-Tropsch wax, polyethylene wax, 12-hydroxystearic acid amide, stearic acid amide, phthalic anhydride imide, and blends of these materials. Preferred carriers include branched paraffinic blends such as Norpar™ 18 (available from Exxon Corporation, N.J.), vegetable waxes, animal waxes, petroleum waxes, silicone waxes, and synthetic waxes.

The roles of the binder resin are to be the vehicle for the pigments or dyes, to provide colloidal stability, and to aid fixing of the final image. The binder resin should contain charging sites or be able to incorporate materials that have charging sites. Furthermore, the binder resin should have a melting point above 22° C., more preferably above 30° C., and most preferably above 40° C. Non-limiting examples of suitable binder resin are crystalline polymers or copolymers derived from side-chain crystallizable and main-chain crystallizable polymerizable monomers, oligomers or polymers with melting transitions above 22° C. Suitable crystalline polymeric binder resins include homopolymers or copolymers of alkyl acrylates where the alkyl chain contains more than 13 carbon atoms (e.g., tetradecyl acrylate, pentadecyl acrylate, hexadecyl acrylate, heptadecyl acrylate, octadecyl acrylate, behenyl acrylate, etc); alkyl methacrylates wherein the alkyl chain contains more than 17 carbon atoms; ethylene; propylene; and acrylamide. Other suitable crystalline polymeric binder resins with melting points above 22° C. are derived from aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; amino functional silicone waxes; polymerizable natural waxes, polymerizable synthetic waxes, and other similar type materials known to those skilled in the art.

Suitable crystalline polymeric binder resins can be also an organosol composed of a high molecular weight (co) polymeric graft stabilizer (shell) covalently bonded to an insoluble, thermoplastic (co)polymeric core. The graft stabilizer includes a crystallizable polymeric moiety that is capable of independently and reversibly crystallizing at or above 22° C. The graft stabilizer includes a polymerizable organic compound or mixture of polymerizable organic compounds of which at least one is a polymerizable crystallizable compound (PCC). Suitable PCC's include side-chain crystallizable and main-chain crystallizable polymerizable monomers, oligomers or polymers with melting transitions above 22° C. Suitable PCC's include alkylacrylates where the alkyl chain contains more than 13 carbon atoms (e.g., tetradecylacrylate, pentadecylacrylate, hexadecylacrylate, heptadecylacrylate, octadecylacrylate, etc); alkylnethacrylates wherein the alkyl chain contains more than 17 carbon atoms, ethylene; propylene; and acrylamide. Other suitable PCCs with melting points above 22° C. include aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; amino functional silicone waxes; polymerizable natural waxes, polymerizable synthetic waxes, and other similar type materials known to those skilled in the art.

Useful colorants are well known in the art and include materials such as dyes, stains, and pigments. Preferred colorants are pigments that may be incorporated into the polymer binder resin, are nominally insoluble in and non-reactive with the carrier, and are useful and effective in making visible the latent electrostatic image. Non-limiting examples of typically suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105, 138 and 111), azo red (C.I. Pigment Red 3, 17, 22, 23, 38, 48:1, 48:2, 52:1, 81, 81:4 and 179), quinacridone magenta (C.I. Pigment Red 122, 202 and 209) and black pigments such as finely divided carbon (Cabot Monarch 120, Cabot Regal 300R, Cabot Regal 350R, Vulcan X72) and the like.

The optimal weight ratio of binder resin to colorant in the developer particles is on the order of 1/1 to 20/1, preferably between 3/1 and 10/1 and most preferably between 5/1 and 8/1. The total dispersed material in the carrier typically represents 0.5 to 70 weight percent, preferably between 5 and 50 weight percent, most preferably between 10 and 40 weight percent of the total developer composition.

An electrophotographic phase change developer may be formulated by incorporating a charge control agent into the phase change developer. The charge control agent, also known as a charge director, provides improved uniform charge polarity of the developer particles. The charge director may be incorporated into the developer particles using a variety of methods, such as chemically reacting the charge director with the developer particle, chemically or physically adsorbing the charge director onto the developer particle (binder resin or pigment), or chelating the charge director to a functional group incorporated into the developer particle. A preferred method is attachment via a functional group built into the graft stabilizer. The charge director acts to impart an electrical charge of selected polarity onto the developer particles. Any number of charge directors described in the art may be used. For example, the charge director may be introduced in the form of metal salts consisting of polyvalent metal ions and organic anions as the counterion. Non-limiting examples of suitable metal ions include Ba(II), Ca(II), Mn(II), Zn(II), Zr(IV), Cu(II), Al(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), and Ti(IV). Non-limiting examples of suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acid, and the like. Preferred positive charge directors are the metallic carboxylates (soaps) described in U.S. Pat. No. 3,411,936, incorporated herein by reference, which include alkaline earth- and heavy-metallic salts of fatty acids containing at least 6–7 carbons and cyclic aliphatic acids including naphthenic acid; more preferred are polyvalent metal soaps of zirconium and aluminum; most preferred is the zirconium soap of octanoic acid (Zirconium HEX-CEM from Mooney Chemicals, Cleveland, Ohio).

The preferred charge direction levels for a given phase change developer formulation will depend upon a number of factors, including the composition of the graft stabilizer and organosol, the molecular weight of the organosol, the particle size of the organosol, the core/shell ratio of the graft stabilizer, the pigment used in making the developer, and the ratio of binder resin to pigment. In addition, preferred charge direction levels will also depend upon the nature of the electrophotographic imaging process, particularly the design of the developing hardware and photoconductive element. Those skilled in the art, however, know how to adjust the level of charge direction based on the listed parameters to achieve the desired results for their particular application.

The useful conductivity range of a phase change developer is from about 10 to 1200 picomho-cm$^{-1}$. High conductivities generally indicate inefficient association of the charges on the developer particles and is seen in the low relationship between current density and developer deposited during development. Low conductivities indicate little or no charging of the developer particles and lead to very low development rates. The use of charge director compounds to ensure sufficient charge associated with each particle is a common practice. There has, in recent times, been a realization that even with the use of charge directors there can be much unwanted charge situated on charged species in solution in the carrier. Such unwanted charge produces inefficiency, instability and inconsistency in the development.

Any number of methods may be used for effecting particle size reduction of the pigment in preparation of the phase change developers. Some suitable methods include high shear homogenization, ball-milling, attritor milling, high energy bead (sand) milling or other means known in the art. The operating temperature during particle size reduction is above the melting point of the crystalline polymeric binder resin. The resulted phase change developer is either cooled to room temperature to form a solid which optionally may be turned into a powder by pulverizing; sprayed to form droplets which then are cooled to form a powder; transferred to a mold and then cooled to form a shaped solid; or coated on a substrate and then cooled to form a coated web with a layer of the phase change developer.

Two modes of development are known in the art, namely deposition of liquid developer 52, 60, 68 and 76 in exposed areas of photoreceptor 10 and, alternatively, deposition of liquid developer 52, 60, 68 and 76 in unexposed regions. The former mode of imaging can improve formation of halftone dots while maintaining uniform density and low background densities. Although the invention has been described using a discharge development system whereby the positively charged liquid developer is deposited on the surface of photoreceptor 10 in areas discharged by the radiation, it is to be recognized and understood that an imaging system in which the opposite is true is also contemplated by this invention. Development is accomplished by using a uniform electric field produced by developer roll 56, 64, 72 and 80 spaced near the surface of photoreceptor 10.

A thin, uniform layer of liquid developer is established on a rotating, cylindrical developer roll 56, 64, 72 and 80. A bias voltage is applied to the developer roll intermediate to the unexposed surface potential of photoreceptor 10 and the exposed surface potential level of photoreceptor 10. The voltage is adjusted to obtain the required maximum density level and tone reproduction scale for halftone dots without any background being deposited. Developer roll 56, 64, 72 and 80 is brought into proximity with the surface of photoreceptor 10 immediately before the latent image formed on the surface of photoreceptor 10 passes beneath the developer roll 56, 64, 72 and 80. The bias voltage on developer roll 56, 64, 72 and 80 forces the charged pigment particles, which are mobile in the electric field, to develop the latent image. The charged "solid" particles in liquid developer will migrate to and plate upon the surface of photoreceptor 10 in areas where the surface charge of photoreceptor 10 is less than the bias voltage of developer roll 56, 64, 72 and 80. The charge neutrality of liquid developer is maintained by oppositely-charged substantially transparent counter ions which balance the charge of the positively charged developer particles. Counter ions are deposited on the surface photoreceptor 10 in areas where the surface voltage of photoreceptor 10 is greater than the developer roll bias voltage.

Photoreceptor 10 may be in the form of a belt or a drum. Photoreceptor 10 may be an organophotoreceptor as described in a previous filed U.S. patent application (Ser. No. 60/242,517), which is incorporated herein by reference. Photoreceptor 10 may also be an inorganic photoreceptor containing at least an inorganic photosensitive material known in the art, such as alpha-silicon and chalcogenide glasses.

What is claimed is:

1. A developer storage and delivery system for liquid electrophotography comprising:

a. a container having an open end;

b. a phase change developer inside said container wherein said phase change developer has a melting point of at least 22° C.; and c. a heater near said open end wherein said heater melts the top surface of said phase change developer;

the heater lowering the viscosity of said developer so that heated developer may move towards said open end.

2. A developer storage and delivery system for effecting liquid electrophotography from a phase change developer source comprising:

b) a container having a dispensing end;

c) a phase change developer inside said container wherein said phase change developer has a melting point of at least 22° C.; and a. a heater to heat at least a surface of the phase change developer in mass transport relationship to the dispensing end;

the heater lowering the viscosity of said developer so that heated developer may move towards said dispensing end.

3. A developer storage and delivery system for liquid electrophotography according to claim 2, wherein said phase change developer comprises a carrier selected from the group consisting of plant oils and waxes, animal oils and waxes, petroleum oils and waxes, synthetic oils and waxes, branched paraffinic oils and waxes, and silicone oils and waxes.

4. A developer storage and delivery system for liquid electrophotography according to claim 2, further comprising a motivator for moving said phase change developer toward said heater in a controlled manner.

5. A developer storage and delivery system for liquid electrophotography according to claim 4, wherein said phase change developer comprises a carrier selected from the group consisting of plant oils and waxes, animal oils and waxes, petroleum oils and waxes, synthetic oils and waxes, branched paraffinic oils and waxes, and silicone oils and waxes.

6. A developer storage and delivery system for effecting liquid electrophotography from a phase change developer source comprising:

d) a container having a dispensing end;

e) a phase change developer inside said container wherein said phase change developer has a melting point of at least 22° C.; and a heater to heat at least a surface of the phase change developer in mass transport relationship to the dispensing end, wherein said phase change developer comprises a crystallizing polymeric binder resin derived from a polymerizable monomer selected from the group consisting of hexacontanyl (meth)acrylate, pentacosanyl (meth)acrylate, behenyl (meth)acrylate, octadecyl (meth)acrylate, hexyldecyl acrylate, tetradecyl acrylate, and amino functional silicones.

7. A developer storage and delivery system for effecting liquid electrophotography from a phase change developer source comprising:

f) a container having a dispensing end;

g) a phase change developer inside said container wherein said phase change developer has a melting point of at least 22° C.; and a heater to heat at least a surface of the phase change developer in mass transport relationship to the dispensing end, wherein said phase change developer comprises an organosol having a graft stabilizer derived from a polymerizable monomer selected form the group consisting of hexacontanyl (meth)acrylate, pentacosanyl (meth)acrylate, behenyl (meth)acrylate, octadecyl (meth)acrylate, hexyldecyl acrylate, tetradecyl acrylate, and amino functional silicones.

8. A developer storage and delivery system for liquid electrophotography comprising:

a) a container having an open end;

b) a developer inside said container wherein said developer has a viscosity greater than 10 pascal second; and c) a heater to lower the viscosity of said developer to less than 0.01 pascal second so that heated developer may move towards said open end.

9. A developer storage and delivery system for liquid electrophotography according to claim 8 wherein said phase change developer comprises a crystallizing polymeric binder resin derived from a polymerizable monomer selected from the group consisting of hexacontanyl (meth) acrylate, pentacosanyl (meth)acrylate, behenyl (meth) acrylate, octadecyl (meth)acrylate, hexyldecyl acrylate, tetradecyl acrylate, and amino functional silicones.

10. A developer storage and delivery system for liquid electrophotography according to claim 8, wherein said phase change developer comprises an organosol having a graft stabilizer derived from a polymerizable monomer selected from the group consisting of hexacontanyl (meth)acrylate, pentacosanyl (meth)acrylate, behenyl (meth)acrylate, octadecyl (meth)acrylate, hexyldecyl acrylate, tetradecyl acrylate, and amino functional silicones.

11. A developer storage and delivery system for liquid electrophotography according to claim 8, further comprising a motivator for moving said phase change developer toward said heater in a controlled manner.

* * * * *